US007793571B2

(12) United States Patent
Streuli

(10) Patent No.: US 7,793,571 B2
(45) Date of Patent: Sep. 14, 2010

(54) MANUALLY OPERATED PLIERS WITH FORCE MONITORING

(75) Inventor: Walter Streuli, Hausen am Albis (CH)

(73) Assignee: Hans Oetiker AG Maschinen-und Apparatel fabrik, Horgen (CH)

( * ) Notice: Subject to any disclaimer, the term of this patent is extended or adjusted under 35 U.S.C. 154(b) by 185 days.

(21) Appl. No.: 12/282,028

(22) PCT Filed: Aug. 25, 2006

(86) PCT No.: PCT/EP2006/008375

§ 371 (c)(1),
(2), (4) Date: Sep. 8, 2008

(87) PCT Pub. No.: WO2008/022649

PCT Pub. Date: Feb. 28, 2008

(65) Prior Publication Data

US 2009/0019974 A1 Jan. 22, 2009

(51) Int. Cl.
*B25B 7/00* (2006.01)
*B25B 7/02* (2006.01)

(52) U.S. Cl. ..... 81/415; 81/427

(58) Field of Classification Search ..... 81/415, 81/427, 427.5, 429, 467
See application file for complete search history.

(56) References Cited

U.S. PATENT DOCUMENTS

| | | | | |
|---|---|---|---|---|
| 4,181,046 | A | 1/1980 | Lamb | |
| RE33,714 | E | 10/1991 | Anderson et al. | |
| 6,073,472 | A | 6/2000 | Hollingworth | |
| 6,112,418 | A | 9/2000 | Strater | |
| 6,598,269 | B2 | 7/2003 | Oetiker | |
| 6,983,506 | B1 * | 1/2006 | Brown | 7/168 |
| 7,107,814 | B2 | 9/2006 | Oetiker | |
| 7,487,654 | B2 * | 2/2009 | Lefavour et al. | 72/31.01 |
| 2006/0011022 | A1 | 1/2006 | Fairburn et al. | |
| 2007/0056412 | A1 | 3/2007 | Wolfson | |
| 2007/0079445 | A1 * | 4/2007 | Siebeck | 7/129 |

FOREIGN PATENT DOCUMENTS

| | | | |
|---|---|---|---|
| DE | 298 06 179 | U1 | 10/1998 |
| EP | 0 679 476 | A2 | 11/1995 |
| EP | 0824979 | | 2/1998 |
| EP | 116 397 9 | | 12/2001 |
| EP | 1163979 | | 12/2001 |
| EP | 119 127 0 | | 3/2002 |
| FR | 2 317 051 | A1 | 2/1977 |
| WO | WO 2006/062733 | A | 6/2006 |

* cited by examiner

*Primary Examiner*—David B Thomas

(57) ABSTRACT

For signaling the force exerted with a manually operated pair of pliers, one arm of the pliers comprises an inner lever and an outer lever, the inner lever carrying a jaw of the pliers and being biased by means of compression springs, with respect to the outer lever which is gripped by the user's hand. The two levers, have opposed contact elements, which contact one another when the actuation force that acts counter the bias of the compression springs, reaches a predetermined value, to actuate a vibrator housed in the arm of the pliers.

7 Claims, 1 Drawing Sheet

MANUALLY OPERATED PLIERS WITH FORCE MONITORING

BACKGROUND

This application is a National Phase Application based upon and claiming the benefit of priority to PCT/EP2006/008375, filed on Aug. 25, 2006, the contents of which are incorporated herein by reference.

DESCRIPTION

Prior Art

Clamping rings are used, for instance, in the automotive industry for fixing flexible hoses on ridged nipples or for fastening bellows on universal shafts. For tightening such clamping rings during manufacture, pneumatic and other pliers are used, such as known from EP 1 163 979 A1. Pliers of this type allow considerable forces to be produced as required for closing and tightening clamping rings. For protecting both the clamping rings and the structural parts to which they are applied, it is common to monitor the force applied and to turn off the actuation of the pliers when the maximum force given for the respective type of clamp is reached. An example of such a force monitoring and controlling device is known from EP 0 824 979 A1.

Outside industrial manufacture, for instance in repair shops, clamping rings are tightened by means of manually operated pliers; compare EP 1 191 270 A1. In this case, whether the clamping ring is tightened with sufficient but not excessive force depends on the skill and experience of the mechanic.

FR 2 317 051 A discloses a manually operated pair of pliers comprising means for generating a signal perceivable by the user's hand when a predetermined closing force between the jaws of the pliers is reached, wherein one arm of the pliers is provided with the signalling means and has an inner lever carrying one jaw of the pliers and an outer lever which is pivotal with respect to the inner lever and co-operates with the other arm to actuate the pliers and is resiliently biased with respect to the inner lever. When the predetermined force is reached, a spring-loaded ball overcomes a cam so that the lever held in the user's hand suddenly yields.

U.S. Re. 33,714 describes a pair of pliers having a mechanism which provides a sensory indication to the operator that the jaws have applied a sufficient crimping force.

WO 2006/062733 A1 discloses a pair of pliers having a vibrator which provides an alarm signal to the user that the pliers approach a live electrical wire.

SUMMARY OF THE INVENTION

It is an object of the invention to provide manually operated pliers which ensure the generation of a predetermined force by an inexpensive structure.

To meet this object, the invention provides a manually operated pair of pliers, particularly for tightening clamping rings, comprising means for generating a signal perceivable by the user's hand when a predetermined closing force between the jaws of the pliers is reached, wherein one arm of the pliers is provided with the signalling means and has an inner lever carrying one jaw of the pliers and an outer lever which is pivotal with respect to the inner lever and co-operates with the other arm to actuate the pliers and is resiliently biased with respect to the inner lever, wherein the signalling means includes a vibrator housed in said one arm, and the two levers are pivotal about the joint of the pliers.

The device of the invention signalises the generation of a predetermined closing force between the jaws of the pliers. This ensures that a predetermined force, e.g. in tightening clamping rings, is reached but not exceeded. The signal which is generated when the predetermined closing force is reached is directly transmitted to the user's hand operating the pliers and is thus definitely perceived. Other than with a visible or audible signal, the mechanic's attention is not distracted, and the signal does not remain unnoticed. Further, since the hand grips the pliers particularly firmly when the predetermined force is reached, the tactile signal is clearly transmitted. Since the levers, which form one of the two arms of the pliers, are pivotal about the same pin about which the arms themselves are pivotal, an additional journal is not needed.

In an embodiment, mutually opposite contact elements are disposed at the two levers for closing an electric supply circuit of the vibrator, and the spacing between the contact elements is adjustable. The pliers may thus be adjusted in such a way that the signal is generated at a closing force that can be individually set in accordance with the respective application, such as the type of clamp to be tightened.

In another embodiment, abutments are provided for limiting the maximum relative movement between the two levers, thereby ensuring the mechanical stability of the pliers.

In yet another embodiment, the outer lever is shaped as a housing enclosing the inner lever, the compression springs, the vibrator and the contact elements, on three longitudinal sides. This is useful in that the lever which is actuated by the user, due to its housing-like shape, protects the signalling means and the parts associated therewith against dirt and damage and has also a robust shape.

BRIEF DESCRIPTION OF THE DRAWING

Embodiments of the invention are explained in more detail below with reference to the drawing, in which.

DETAILED DESCRIPTION OF A PREFERRED EMBODIMENT

Figure 1:
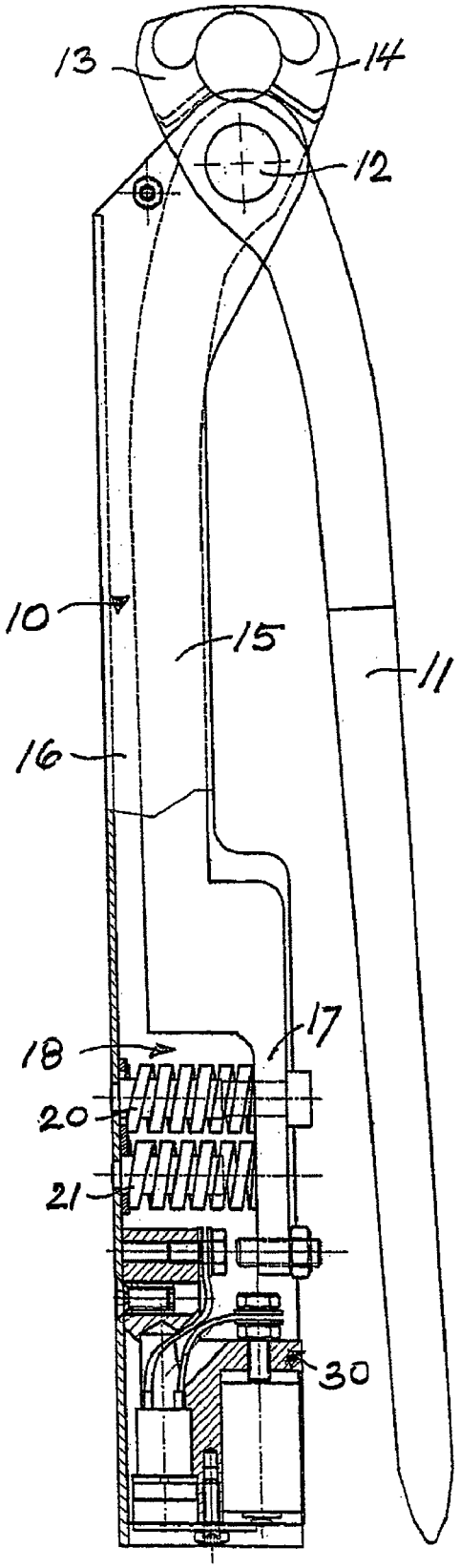
FIG. 1 is a partly cut-away side view of a pair of pliers with a signalling device.

The pliers shown in the drawing has two arms 10, 11 articulated to each other by a pin 12, each arm having a jaw 13, 14. The arm 10 includes an inner lever 15 and an outer lever 16, the inner lever 15 being integral with the jaw 14. The outer lever 16 is also mounted for pivotal movement about the pin 12. An end portion 17 of the inner lever 15 is offset toward the arm 11 with respect to the portion of the inner lever 15 mounted on the pin 12 to form a space 18 between the end portion 17 of the inner lever 15 and the outer lever 16.

Figure 2:
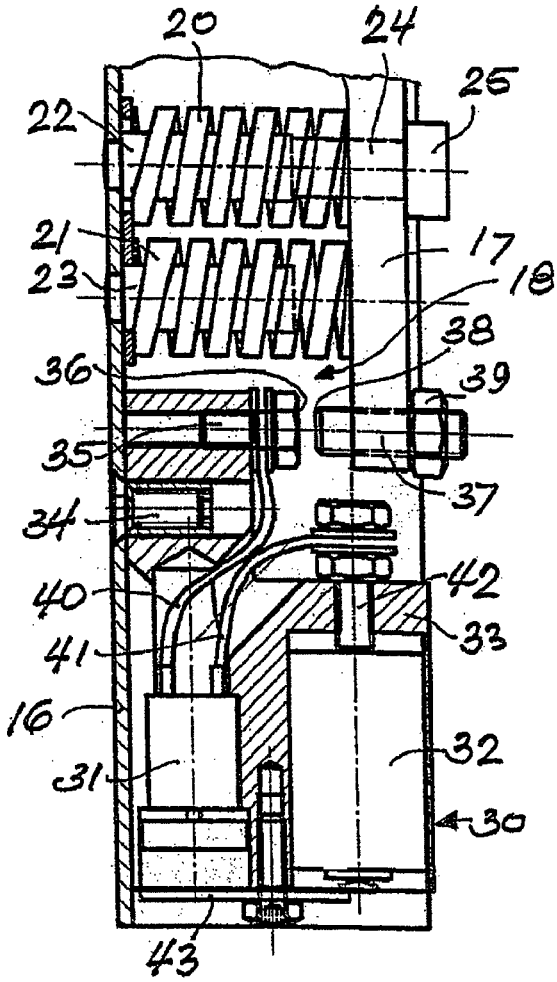
FIG. 2 is an enlarged view of the signalling device.

The components housed in the space 18 are shown in FIG. 2 on an enlarged scale. These components include two compression springs 20, 21, each of which is mounted on a pin 22, 23 fixed to the outer lever 15 for biasing the levers 15, 16 with respect to each other.

The free end of the pin 22, which is the right-hand end according to FIG. 2, is engaged by a screw 24 which passes through a bore in the end portion 17 of the inner lever 15 and has a head 25 abutting the surface of the end portion 17 facing the arm 11 of the pliers, thereby defining the maximum distance between the levers 15 and 16.

The free end of the pin 23, which is the right-hand end according to FIG. 2, is opposite the inner surface of the end portion 17 facing the arm 11 of the pliers and co-operates with the latter to form an abutment for limiting the minimum distance between the levers 15 and 16.

The space 18 further houses a signalling device designated in total by reference number 30 and including a vibrator 31 and a battery 32. The vibrator 31 and the battery 32 are housed within a plastic part 33 which is shown hatched in FIG. 2 and is mounted on the outer lever 16 by means of a screw 34.

A screw 35 is inserted in the plastic part 33, the head of the screw 35 forming a contact element 36. The end portion 17 of the inner lever 15 is penetrated by a stud screw 37 the inner end of which is opposite the head of the screw 35 and forms a second contact element 38. The spacing between the contact elements 36, 38 can be varied by rotating the stud screw 37, the position of the stud screw 37 being secured by a counter nut 39.

In use, the hand grips the pliers in such a way that an actuation force is exerted on the arm 11 of the pliers and the outer lever 16 of the arm 10. The force exerted on the outer lever 16 is transferred to the inner lever 15, and thus to the jaw 14, via the compression springs 20, 21.

When the jaws 13, 14 close about the object to be compressed, any further force exerted will cause the outer lever 16 to pivot toward the inner lever 15 against the bias of the compression springs 20, 21 until the contact elements 36, 38 contact each other. This closes an electric circuit which extends from the contact element 36 via a lead wire 40, the vibrator 31, a further lead wire 41, a contact pin 42, the battery 32, a contact foil 43 and the metal portions of the levers 15, 16 of the arm 11 of the pliers to the contact element 38. The vibrator 31 is thereby supplied with current and causes the outer lever 16 held by the user's hand to vibrate. This is a signal indicating to the user that a predetermined force has been reached. This force can be adjusted, depending on the object on which the pliers are applied, by varying the spacing between the contact elements 36, 38.

The outer lever 16 of the arm 10 of the pliers has a U-shaped cross-section to form a housing which encloses the inner lever 15, the end portion 17 thereof, the compression springs 20, 21, and the plastic part 33 with the components disposed therein on three sides, namely on the left-hand outer side, according to the drawing, and the two sides parallel to the drawing plane. The signalling device 30 and the appertaining components are thus protected against mechanical damage and contamination. The closed structural shape also avoids injuries to the user's hand.

Although the present invention has been described and illustrated in detail, it is to be clearly understood that the same is by way of illustration and example only, and is not to be taken by way of limitation. The scope of the present invention is to be limited only by the terms of the appended claims.

The invention claimed is:

1. A manually operated pair of pliers, particularly for tightening clamping rings, comprising:

a pair of arms pivotably connected at a joint, each arm having a jaw, a vibrator provided on one of the arms for generating a signal perceivable by the user's hand when a predetermined closing force between the jaws is reached, wherein the one arm has an inner lever carrying one of the jaws and an outer lever which is pivotal with respect to the inner lever, the outer lever co-operating with the other one of the arms to actuate the pliers and being resiliently biased with respect to the inner lever, the inner and outer levers being pivotal about the joint.

2. The pliers of claim 1 wherein the resilient bias is provided by two compression springs which are disposed in parallel between the inner and outer levers.

3. The pliers of claim 1 wherein mutually opposite contact elements are disposed at the inner and outer levers for closing an electric supply circuit of the vibrator.

4. The pliers of claim 3 wherein the spacing between the contact elements is adjustable.

5. The pliers of claim 3 wherein the outer lever is shaped as a housing enclosing the inner lever, the compression springs, the vibrator and the contact elements, on three longitudinal sides.

6. The pliers of claim 1 including abutments for limiting the maximum relative movement between the inner and outer levers.

7. The pliers of claim 1 wherein the outer lever is shaped as a housing enclosing the inner lever and the vibrator on three longitudinal sides.

* * * * *

UNITED STATES PATENT AND TRADEMARK OFFICE

CERTIFICATE OF CORRECTION

PATENT NO. : 7,793,571 B2
APPLICATION NO. : 12/282028
DATED : September 14, 2010
INVENTOR(S) : Walter Streuli It is certified that error appears in the above-identified patent and that said Letters Patent is hereby corrected as shown below:

On the Title Page Item "(73) Assignee:" should read --Hans Oetiker AG Maschinen- und Apparatefabrik--.

Signed and Sealed this
Twenty-eighth Day of December, 2010

David J. Kappos

David J. Kappos
*Director of the United States Patent and Trademark Office*